US005430599A

United States Patent [19]

Charpentier et al.

[11] Patent Number: 5,430,599

[45] Date of Patent: Jul. 4, 1995

[54] SYSTEM FOR OPENING/CLOSING CIRCUIT BREAKERS

[75] Inventors: Claude Charpentier, Verdun; Raymond Rajotte, St. Leonard, both of Canada

[73] Assignee: Hydro-Quebec, Montreal, Canada

[21] Appl. No.: 34,397

[22] Filed: Mar. 18, 1993

[51] Int. Cl.[6] ..... H01H 9/00

[52] U.S. Cl. ..... 361/152; 361/187

[58] Field of Search ..... 361/2, 5, 6, 7, 139, 361/143, 152, 160, 170, 187, 206

[56] References Cited

U.S. PATENT DOCUMENTS

| | | | |
|---|---|---|---|
| 4,249,088 | 2/1981 | Kleba et al. | 307/87 |
| 4,878,144 | 10/1989 | Nebon | 361/2 |
| 4,897,755 | 6/1990 | Polster et al. | 361/2 |
| 5,119,260 | 6/1992 | Huhse et al. | 361/2 |

FOREIGN PATENT DOCUMENTS 0338374 10/1989 European Pat. Off. .

OTHER PUBLICATIONS

Patent Abstracts of Japan, vol. 14, No. 394 (E-0969), Aug. 24, 1990, JP-A-02 148 638, Jun. 7, 1990.

Patent Abstracts of Japan, vol. 16, No. 27 (E-1158), Jan. 23, 1992, JP-A-03 241 625, Oct. 28, 1991.

*Primary Examiner*—Jeffrey A. Gaffin

*Attorney, Agent, or Firm*—Oblon, Spivak, McClelland, Maier & Neustadt

[57] ABSTRACT

The system for timing the opening and closing of a high power switching arrangement breaker used in an electrical transmission system measures the temperature of the breaker and the phase of the power signal being switched. A control circuit provides a control signal for opening and closing the breaker in response to an initiating signal, the control signal being timed as a function of the temperature and the phase angle to make sure that contact is either made or broken at an appropriate time to reduce arcing. By taking into consideration temperature and its effects on the response of the breaker, arcing is significantly reduced.

13 Claims, 3 Drawing Sheets to
tco
tmo
ty
tarc
BREAKER CLOSED
OPEN tc
tcc
8.33 ms
tdel
tmc
tx
CLOSED
BREAKER OPEN

SYSTEM FOR OPENING/CLOSING CIRCUIT BREAKERS

BACKGROUND OF INVENTION

1. Field of the Invention

The invention relates to a system for timing the opening and closing of switching arrangements used in high power electrical transmission systems. More specifically, the invention relates to such a system which takes into account conditions of temperature surrounding the switching arrangements as well as the mechanical displacement time of the electrical contacts of the switching arrangements.

2. Description of Prior Art

Switching arrangements, for example, circuit breakers, are used in electrical transmission lines or distribution lines to redirect power, or are used to connect the lines to reactive elements to correct power factor. Such breakers, because of the large amounts of power they must handle, are very large (approximately the size of a small house on each phase) and are very costly.

Associated with such breakers are resistive elements, which are connected in parallel to the breakers just before the opening and closing of the breakers, to absorb the "overvoltages" which accompany the opening and closing of the breakers to thereby protect the switching elements of the breakers as well as the reactive elements. The resistive elements are also large and expensive.

It is a well known fact in the art that the temperature surrounding the breaker has an effect on the speed of operation of the breakers. Generally speaking, the lower the temperature, the greater amount of time needed to open or close the breakers and vice-versa.

SUMMARY OF INVENTION

It is an object of the invention to provide a system for timing the opening and closing of switching arrangements which obviates the needs for resistive elements.

It is a more specific object of the invention to provide such a timing system which will open and close the breakers at such a time in the cycle of the transmitted signal whereby to minimize the overvoltage due to the opening and closing of the breaker.

In accordance with a particular embodiment of the invention there is provided a system for timing the opening and closing of a switching arrangement used in high power electrical transmission systems which transmit at least one phase of a power signal having a sinusoidal variation, comprising:

switch means for providing an OPEN/CLOSE initiating signal for initiating the opening/closing of said switch arrangement;

zero crossing detector means for detecting zero crossings of said power signal and for providing a zero crossing signal upon detection of a zero crossing;

processor means;

controller means;

analog-to-digital converter means;

temperature sensing means for sensing the temperature of said switching arrangement;

first conductor means connecting said power signal to a first input of said analog-to-digital converter means when said switching arrangement is open;

second conductor means connecting said power signal to a second input of said analog-to-digital converter means when said switching arrangement is closed;

third conductor means connecting said power signal to a first input of said zero crossing detector when said switching arrangement is open;

fourth conductor means connecting said power signal to a second input of said zero crossing detector means when said switching arrangement is closed;

fifth conductor means connecting said temperature sensing means to a third input of said analog-to-digital converter means;

said analog-to-digital converter means being connected to a first input of said processor means;

said zero crossing detector being connected to a second input of said processor means;

said switch means being connected to a third input of said processor;

said processor means being connected to an input of said controller means;

whereby, upon detection of an initiating signal, said processor, after receiving a zero crossing signal, causes said controller to carry out a series of predetermined steps to open/close said switching arrangement.

From a different aspect and in accordance with a particular embodiment of the invention there is provided a method for timing the opening and closing of a switching arrangement used in high power electrical transmission systems which transmit at least one phase of a power signal having a sinusoidal variation, comprising:

providing an OPEN/CLOSE initiating signal to a processor to initiate the opening/closing of said switching arrangement;

detecting a zero crossing of said power signal and providing a zero crossing signal to said processor upon detection of said zero crossing;

said processor, upon detection of a first zero crossing signal after an opening/closing signal, causing a controller to carry out a series of predetermined steps.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
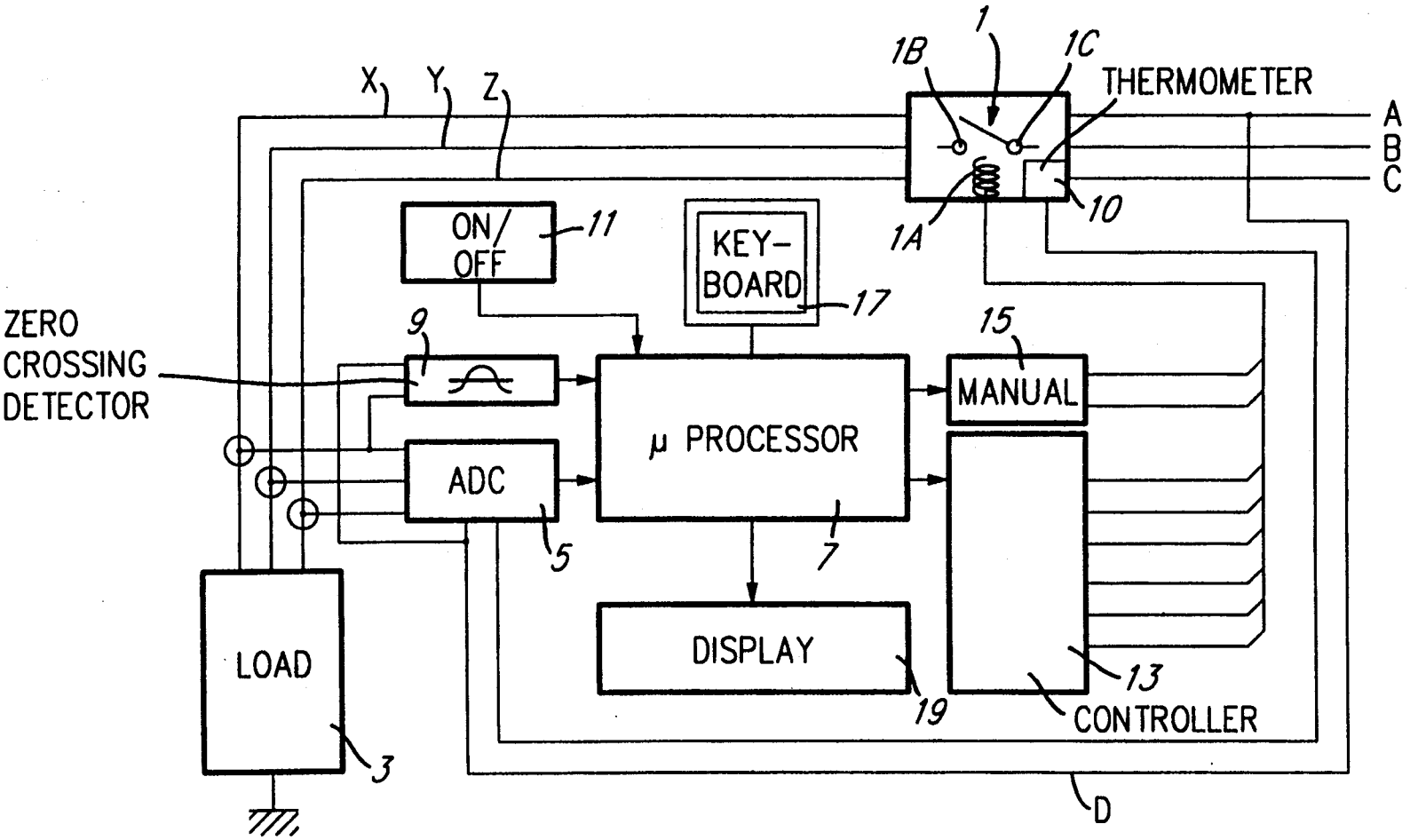
FIG. 1 is a block diagram of the system.

Referring to FIG. 1, a circuit breaker, illustrated schematically at 1, and having coil means represented schematically at 1A and electrode means represented schematically at 1B and 1C, is connected between the three phases, A, B and C, of transmitted power, and a reactive element illustrated schematically at 3. When the breaker is opened, the measured tension of one of the phases, in the illustrated embodiment phase A, is connected to an analog-to-digital (A/D) converter 5 by conductor D. The magnitude, frequency and other characteristics of the phase A signal are translated from an analog value to a digital value in A/D converter 5, and the digital signal is then fed to a microprocessor 7. In addition, the phase A signal is fed to zero detector 9 wherein the zero crossings of the phase A signal are detected. When a phase A zero crossing is detected, a pulse or other indication is fed to the microprocessor 7. As will be apparent, the zero crossings of phase A are used for synchronization purposes.

A thermometer, illustrated schematically at 10, measures the temperature surrounding the circuit breaker. An electrical analog of the temperature is then fed to the A/D (analog to digital) converter 5, and the digital conversion of the temperature is also fed to the microprocessor 7.

When the breaker is closed, phase A, B and C signals are fed along conductors X, Y and Z, and the phases A, B and C measured currents are fed to the A/D converter 5 as shown in FIG. 1. Once again, the analog signals are converted to digital signals and the digital signals are fed to the microprocessor 7. The signal of the phase A is also fed to the zero detector 9, and, once again, a pulse or other indication is fed to the processor 7 when a zero crossing is detected.

The currents on phases A, B and C are monitored in order to detect any restrike that might occur when the circuit breaker opens or high inrush current when the circuit breaker closes.

Alarm signals are generated when a restrike or a high inrush current occurs on any of the three phases.

The opening or closing of the breaker is initiated by ON/OFF switch 11. The signal from the ON/OFF switch is, once again, fed to the microprocessor 7.

The output of the microprocessor 7 is fed to a controller 13 which will either open or close the breakers, associated with the A, B or C phases under the control of the microprocessor 7, by carrying out a series of predetermined, timed, steps as described below. If the system cannot operate to open or close the breaker under the control of the controller 13, an emergency override 15 is provided to open or close the breakers, once again, under control of the microprocessor 7.

A keyboard 17 is provided for the purpose of programming the microprocessor 7, as is well known in the art, and a display unit 19 is provided for examining various parameters and alarm signals, once again, as is well known in the art.

To understand the operation of the system, reference is had to FIG. 2, for an understanding of the opening operation, and to FIG. 3 for an understanding of the closing operation. Generally, the system is either in a waiting mode, that is, when an opening or closing has not been commanded, or an active mode in which the breaker is either being opened or closed. In the waiting mode, temperature readings are taken at predetermined intervals by the thermometer 10, and an electrical analog of the temperature is provided to the A/D converter 5. The digital representation of the temperature is then provided to the processor 7.

At the same time, during the waiting mode, the functionality of the system is verified by means well known in the art. Parameters are also calculated taking into account the changing temperature.

Figures 2A, 2B, 2C, 2D, 2E, 2F:
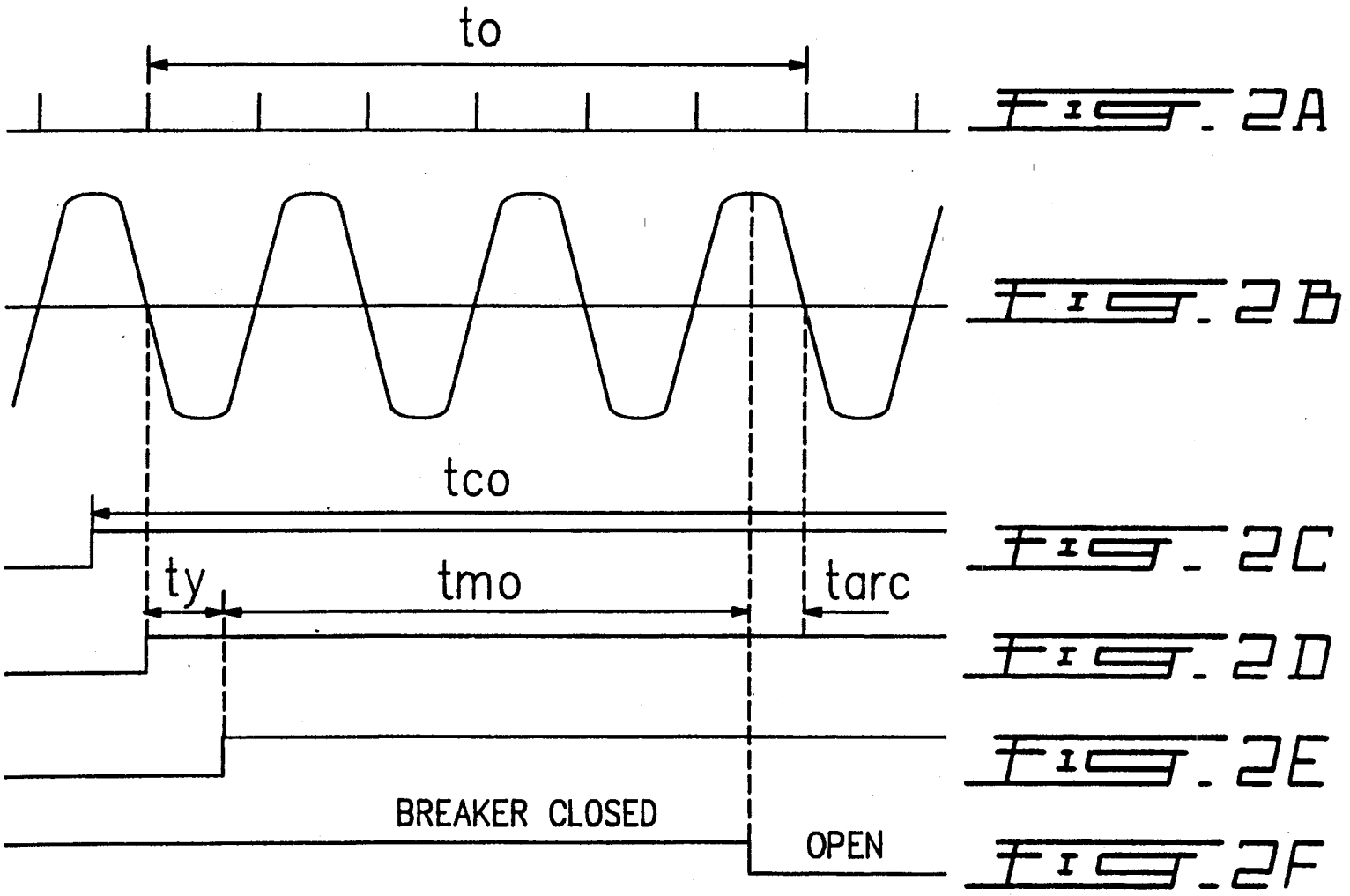
FIG. 2A illustrates the number of integral cycles in which the complete opening procedure is performed in the preferred embodiment.
FIG. 2B illustrates the first phase power signal.
FIG. 2C illustrates the initiating signal.
FIG. 2D illustrates the phase indication signal according to the preferred embodiment.
FIG. 2E illustrates the breaker activation signal according to the preferred embodiment.
FIG. 2F illustrates the state of the breaker.

Turning now to FIG. 2, in accordance with the invention, the complete opening procedure, $t_o$, is performed during an integral number of cycles, i.e. in a time n ($t_{cycle}$), where $t_{cycle}$=period of a cycle and n=a predetermined integer. As illustrated in FIG. 2A, the number of integral cycles in which the complete opening procedure is performed in one particular embodiment is 3. As illustrated in FIG. 2B, the transmitted signal is a sinusoid. In North America, the frequency of the transmitted signal is, of course, 60 Hz so that $t_{cycle}$=16.67 msec..

The signal for opening the breaker (separating the electrodes of the breakers from each other: the signal is initiated by pressing the ON button in the switch 11 in FIG. 1) is given at the beginning of a period $t_{co}$. The signal $t_{co}$ is illustrated in FIG. 2C and is the time duration during which the opening signal remains high. As can be seen in FIG. 2C, $t_{co}$ remains high during the entire opening procedure and stays open until a closing signal is initiated.

The high level at the onset of $t_{co}$ is fed to the microprocessor 7 and the microprocessor 7 then seeks a zero of the sinusoid at the first zero crossing after the initiation of $t_{co}$. As seen in FIGS. 2B and 2D, this occurs at the beginning of the period $t_y$ in FIG. 2D.

It is only after the waiting period $t_y$, that is, at the beginning of the period $t_{mo}$, (see FIG. 2D) that power is applied to the coil of the circuit breaker to initiate the movement for the physical separation of the electrodes of the breaker as shown in FIG. 2E.

As seen in FIGS. 2F and 2D, the contacts separate at the conclusion of the period $t_{mo}$, that is, at a period $t_{arc}$ before the next zero crossing.

When the electrodes of the breakers are physically separated, an arc is formed between the electrodes. The arc is extinguished when the current reaches the zero level, that is, at the conclusion of the period $t_{arc}$.

To prevent restrikes inside the breaker after the current goes to zero, the duration of the arc, identified as $t_{arc}$ in FIG. 2D, should be greater than 3 milliseconds. If it is less than this, then the current will pass through zero and increase (in either a positive or negative direction) while the arc is still strong enough to restrike. Accordingly, $t_{arc}$ should be a minimum of 3 milliseconds.

In addition, to guard against the uncontrollable variation in the amount of time that it takes for the physical separation of the electrodes to occur ($t_{mo}$), which variation could be of the order of 2 milliseconds, it is preferable that the period $t_{arc}$ should be of the order of 5 milliseconds.

The actual magnitude $t_{arc}$ is entered into microprocessor 7 by keyboard 17. The period $t_{mo}$ is determined by a calibration procedure at a standard temperature, for example, 20° C.

It will then be observed that $$t_o = t_y + t_{mo} + t_{arc} \quad (1)$$

As $t_o$ is known (in the present example, $t_o$=3 cycles. In the North American case, each cycle is equal to 16.6 msec so that $t_o$=50 msec) and $t_{arc}$ is selected to be of the order of 5 milliseconds. The value of $t_{mo}$ is determined, at the standard temperature, by calibration, and the value of $t_y$ is calculated by the microprocessor 7.

In order to determine the values of the above periods at temperatures other than 20° C., the opening time $t_{mo2}$ at temperature $T_2$ is calculated using the relationship $$t_{mo2}=t_{mo1}-a_o(T_2-T_1) \quad (2)$$

where $a_o$ is a value which is indicative of the sensitivity of the breaker to temperature and is given by the breaker manufacturer $T_2$ is equal to the temperature of interest $T_1$is equal to the standard temperature is equal to, in a particular embodiment, 20° C.

$t_{mo1}$ is equal to the switch opening time at 20° C.

$t_{mo2}$ is equal to the switch opening time at $T_2$.

The value of $t_{mo2}$ is calculated with equation (2), and the value of $t_y$ is calculated using the programmed value of $t_{arc}$ and the calculated value of $t_{mo2}$ applied in equation (1) above.

With the above calculation, the parameters for opening the breaker are determined. The processor 7 sends out signals to the controller 13 which initiates appropriate action (e.g. applying an opening signal to the coil of the breaker) to affect the opening in accordance with the calculated timing.

As seen from FIG. 1, the zero crossing is determined only for phase A. However, as phases B and C have a known phase relationship to phase A (e.g. phase B is separated from phase A by angle $P_a$ and phase C is separated from phase B by angle $P_b$), timing for these phases is determined in a straightforward manner. Specifically, the zero crossing occurs at $P_a/360$ ($t_{cycle}$) msec after the zero crossing for phase A. In a like manner, the zero crossing for phase C occurs at $p_b/360$ ($t_{cycle}$) after the zero crossing for phase A.

In practice, temperature readings are taken at predetermined intervals and the value for $t_{mo}$ is calculated whenever a temperature reading is taken. When an actuating signal is received, the value of the last calculated $t_{mo}$ is used.

In addition, the $t_{mo}$ of phase A may not be identical with the $t_{mo}$ of phase B or of phase C. Accordingly, separate calculations have to be made at each temperature for the value $t_{mo}$ of each phase. Further, the value $a_o$ may also be different from each phase. The values for $a_o$ for each phase are stored in the processor 7 and are identified as such to perform appropriate calculations.

As is also well known, it is not possible to continuously convert the analog signal to a digital value. Instead, samples have to be taken. In accordance with a particular embodiment of the invention, 32 samples are taken during each cycle of the voltage/current.

Figures 3A, 3B, 3C, 3D, 3E, 3F:
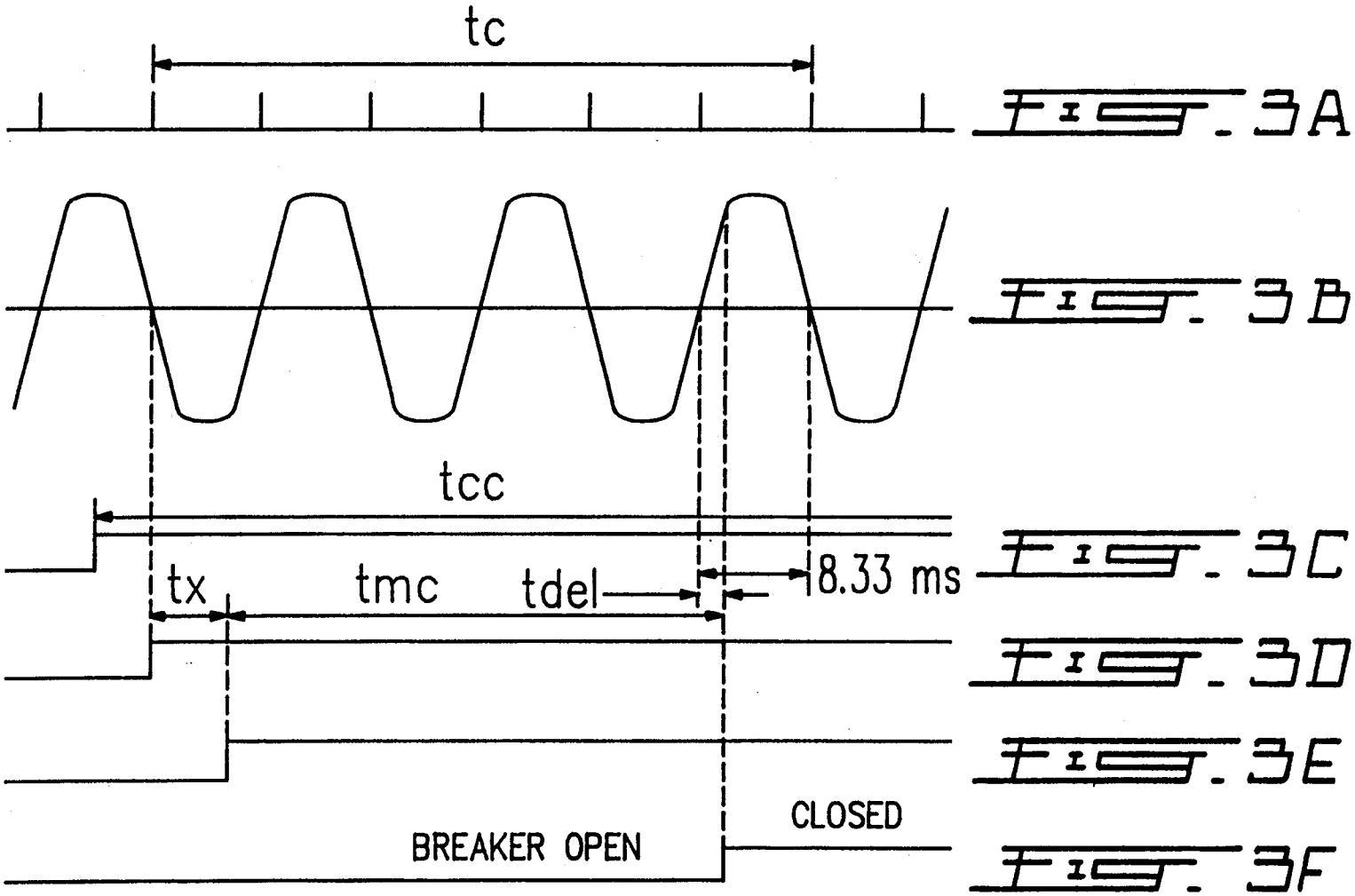
FIGS. 3A through 3F correspond to FIGS. 2A through 2F for the equivalent sequence of events during closing of the breaker according to the preferred embodiment.

The parameters for determining the closing times for the breakers are illustrated in FIG. 3. As seen in FIG. 3A, the total closing time $t_c$ is once again equal to an integral number of cycles. Once again, the number of cycles illustrated in FIG. 3 is 3.

The closing signal is, as seen in FIG. 3C, initiated at the beginning of the time period $t_{cc}$. Once again, the computer monitors for the first zero crossing, illustrated in FIGS. 3B and 3D as appearing at the beginning of the time period $t_x$. $t_x$ is a waiting period and a closing signal is applied to the coil of the breaker at the expiration of the period $t_x$. As seen in FIGS. 3D and 3E, this occurs at the beginning of the period $t_{mc}$. The period $t_{mc}$, that is, the time that it takes the contacts to move from an open to a closed position, is once again a function of the particular breaker and is once again calibrated at a standard temperature, for example, 20° C. In order to determine the period $t_{mc2}$ for a temperature $T_2$, different from 20° C., use is made of the relationship $$t_{mc2}=t_{mc1}-a_c(T_2-T_1) \quad (3)$$

where $a_c$ is once again given by the manufacture of the breakers.

It can also be seen from FIG. 3 that $$t_c=t_x+t_{mc}+8.33 \text{ msec}-t_{del} \quad (4)$$

As $t_c$ and $t_{mc}$ are already known, and as $t_{del}$ is selected to enable the exact point of initiation (the onset of the period $t_{mc}$) to be fixed with exactness, the period $t_{del}$ is also known, and the period $t_x$ can be determined from equation (4).

By definition, $t_{del}$ is the time delay between the last zero crossing of the phase voltage before the mechanical closure of the circuit breaker contacts and the actual contact closure. When the circuit breaker is used with an inductance or with a transformer, $t_{del}$ should be set around 2 ms in order to avoid the high inrush currents which can cause high electrodynamic stresses on the windings. High inrush currents occur when the breaker contacts close near zero phase voltage i.e. when $t_{del}$ is close to zero. Conversely, when the circuit breaker is used with a capacitor bank, $t_{del}$ should be close to zero in order to prevent high inrush currents which would stress the capacitors and damage the contacts of the circuit breaker.

As seen in FIG. 3F, the contacts move from an open to a closed position upon termination of the period $t_{mc}$. Once again, the timing of phases B and C are determined knowing the relationship between the signals on phases A, B and C. In addition, the value $t_{mc2}$ must be separately calculated for each phase A, B or C taking into account the value of $a_c$ and of $T_2$.

Although a particular embodiment has been described, this was for the purpose of illustrating, but not limiting, the invention. Various modifications, which will come readily to the mind of one skilled in the art, are within the scope of the invention as defined in the appended claims.

We claim:

1. A system for timing the opening and closing of a switching arrangement used in high power electrical transmission systems which transmit at least one phase of a power signal having a sinusoidal variation, comprising:

switch means for providing an OPEN/CLOSE initiating signal for initiating the opening/closing of said switch arrangement;

phase angle detector means for detecting a phase of said power signal and for providing a phase indication signal;

temperature sensing means for sensing the temperature of said switching arrangement and producing a temperature signal; and control means connected to said switch means, said phase detector means, and said temperature sensing means for opening and closing said switching arrangement in response to said initiating signal timed as a function of said temperature signal and said phase indication signal.

2. A system as defined in claim 1 wherein said switching arrangement includes two electrodes and a coil;

said electrodes, when in contact with each other, being separated upon application of an opening signal to said coil;

said electrodes, when separated from each other, being moved towards each other to contact each other upon application of a closing signal to said coil.

3. A system as defined in claim 2 wherein said control means carry out steps including, when said electrodes are in contact with each other:

after a waiting time $t_y$ after a zero crossing of said power signal applying said opening signal to said coil;

said electrodes being separated from each other after a period of time $t_{mo2}$;

the termination of said period $t_{mo2}$ occurring a period $t_{arc}$ before the next zero crossing of said power signal;

said control means including means for calculating $t_{mo2}$ for different temperatures according to the formula:

$$t_{mo2}=t_{mo1}-a_o(T_2-T_1)$$

where $a_o$ is a value which is indicative of the sensitivity of the breaker to temperature and is given by the breaker manufacturer $T_2$ is equal to the temperature of interest $T_1$ is equal to the standard temperature is equal to, in a particular embodiment, 20° C.

$t_{mo1}$ is equal to the switch opening time at 20° C.

$t_{mo2}$ is equal to the switch opening time at temperature $T_2$.

4. A system as defined in claim 3 wherein said control means includes means for calculating a waiting time $t_y$ from the formula:

$$t_o=t_y+t_{mo2}+t_{arc}$$

where $t_o$=a predetermined integral number of periods of said power signal $t_y$=waiting time $t_{arc}$=arcing time.

5. A system as defined in claim 2 wherein said control means carry out steps, including when said electrodes are separated from each other:

after a waiting period $t_x$ after a zero crossing of said power signal applying said closing signal to said coil;

said coil being closed after a period $t_{mc2}$;

said control means including means for calculating $t_{mc}$ for different temperatures according to the formula:

$$t_{mc2}=t_{mc1}-a_c(T_2-T_1)$$

where $a_c$=a value which is indicative of the sensitivity of the breaker to temperature and is given by the breaker manufacturer $T_2$=temperature of interest $T_1$=standard temperature is equal to, in a particular embodiment, 20° C.

$t_{mc1}$=switch closing time at 20° C.

$t_{mc2}$=switch closing time at temperature $T_2$.

6. A system as defined in claim 5 wherein said control means includes means for calculating $t_x$ from the formula:

$$t_c=t_x+t_{mc2}+8.33\text{ msec}-t_{del}$$

where $t_c$=a predetermined integral number of periods of said power signal $t_x$=waiting time $t_{del}$=a time delay period.

7. A system as defined in any one of claims 1, 2, 3, 4, 5 or 6 wherein said electrical transmission system transmits three phases of said power signal comprising a first phase, a second phase and a third phase;

said first phase being separated from said second phase by a phase angle $P_a$;

said second phase being separated from said third phase by a phase angle $P_b$;

said control means including means for initiating opening and closing a second phase portion of said switching arrangement at a time $P_a/360$ ($t_{cycle}$) after said control means has initiated opening and closing for said first phase; and said control means including means for initiating opening and closing a third phase portion of said switching arrangement at a time $P_b/360$ ($t_{cycle}$) after said control means has initiated opening and closing for said first phase.

8. A method for timing the opening and closing of a switching arrangement used in high power electrical transmission systems which transmit at least one phase of a power signal having a sinusoidal variation, comprising:

providing an OPEN/CLOSE initiating signal to initiate the opening/closing of said switching arrangement;

detecting a phase angle of said power signal and providing a phase indication signal to said processor;

sensing a temperature of said switching arrangement and producing a temperature signal;

controlling opening and closing of said switching arrangement in response to said initiating signal timed as a function of said temperature signal and said phase indication signal.

9. A method as defined in claim 8 wherein said switching arrangement includes a coil and two electrodes and wherein said step of controlling includes, when said electrodes are in contact with each other:

after a waiting time $t_y$ applying an opening signal to said coil;

said electrodes being separated from each other after a period of time $t_{mo}$;

the termination of said period $t_{mo}$ occurring a period $t_{arc}$ before the next zero crossing of said power signal;

said processor calculating $t_{mo}$ for different temperatures according to the formula:

$$t_{mo2}=t_{mo1}-a_o(T_2-T_1)$$

where $a_o$ is a value which is indicative of the sensitivity of the breaker to temperature and is given by the breaker manufacturer $T_2$ is equal to the temperature of interest $T_1$ is equal to the standard temperature is equal to, in a particular embodiment, 20° C.

$t_{mo1}$ is equal to the switch opening time at 20° C.

$t_{mo2}$ is equal to the switch opening time at $T_2$.

10. A method as defined in claim 9 wherein $t_y$ is calculated from the formula:

$$t_o = t_y + t_{mo2} + t_{arc}$$

where $t_o$=a predetermined integral number of periods of said power signal $t_y$=waiting time $t_{arc}$=arcing time.

11. A method as defined in claim 8 wherein said step of controlling, when said electrodes are separated from each other, comprises:

after a waiting period $t_x$ applying a closing signal to said coil;

said electrodes being closed after a period $t_{mc}$;

calculating $t_{mc}$ for different temperatures according to the formula:

$$t_{mc2} = t_{mc1} - a_c (T_2 - T_1)$$

where $a_c$=a value which is indicative of the sensitivity of the breaker to temperature and is given by the breaker manufacturer $T_2$=temperature of interest $T_1$=standard temperature is equal to, in a particular embodiment, 20° C.

$t_{mc1}$=switch closing time at 20° C.

$t_{mc2}$=switch closing time at temperature $T_2$.

12. A method as defined in claim 11 wherein $t_x$ is calculated from the formula:

$$t_c = t_x + t_{mc2} + 8.33 \text{ msec} - t_{del}$$

where $t_c$=a predetermined integral number of periods of said power signal $t_x$=waiting time at temperature $T_2$ $t_{del}$=a time delay.

13. A method as defined in any one of claims 8, 9, 10, 11 or 12 wherein said electrical transmission system transmits three phases of said power signal comprising a first phase, a second phase and a third phase;

said first phase being separated from said second phase by a phase angle $P_a$;

said second phase being separated from said third phase by a phase angle $P_b$;

said step of controlling further comprising steps of controlling a portion of said switching arrangement for said second phase and for said third phases, wherein opening and closing of said portions for said second phase is initiated at a time $P_a/360$ ($t_{cycle}$) after initiation for said first phase;

opening and closing of said portions for said third phase is initiated at a time $P_b/720$ ($t_{cycle}$) after initiation for said first phase.

* * * * *